United States Patent [19]

Linstead

[11] 4,007,610

[45] Feb. 15, 1977

[54] HAND KNITTING APPARATUS

[76] Inventor: Lorraine A. Linstead, 4643 Cardamon Lane, Rockford, Ill. 61111

[22] Filed: Apr. 13, 1976

[21] Appl. No.: 676,510

[52] U.S. Cl. ..... 66/117

[51] Int. Cl.[2] ..... D04B 35/02

[58] Field of Search ..... 66/116, 117, 118

[56] References Cited

UNITED STATES PATENTS

| | | | |
|---|---|---|---|
| 1,999,691 | 4/1935 | Graham | 66/117 |
| 2,093,631 | 9/1937 | Burnham | 66/117 |
| 2,183,791 | 12/1939 | Dunn | 66/117 |
| 2,208,124 | 7/1940 | Dunn | 66/117 |
| 2,242,880 | 5/1941 | Dunn | 66/117 |
| 2,309,528 | 1/1943 | Otting et al. | 66/117 |
| 3,280,595 | 10/1966 | Linstead | 66/117 |

FOREIGN PATENTS OR APPLICATIONS

| | | | |
|---|---|---|---|
| 1,585,297 | 11/1969 | Germany | 66/117 |
| 1,807,772 | 5/1970 | Germany | 66/117 |

*Primary Examiner*—Ronald Feldbaum

[57] ABSTRACT

A case holds a plurality of different size knitting needles, flexible cords, flanged stitch holders, and coupling members. The parts may be combined to form stitch holders, or circular or straight needle assemblies in different sizes, tips and lengths. The needles have a generally cylindrical body with a tip at one end and a coupling end. The flexible cords or elongate units have a body with an outer diameter not greater than the needle and likewise have coupling ends. The coupling ends of the needle and elongate units have cooperative means providing a disconnectable twist-type connection.

18 Claims, 17 Drawing Figures

Fig. 8.
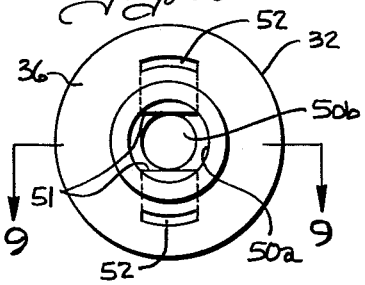
Fig. 7.
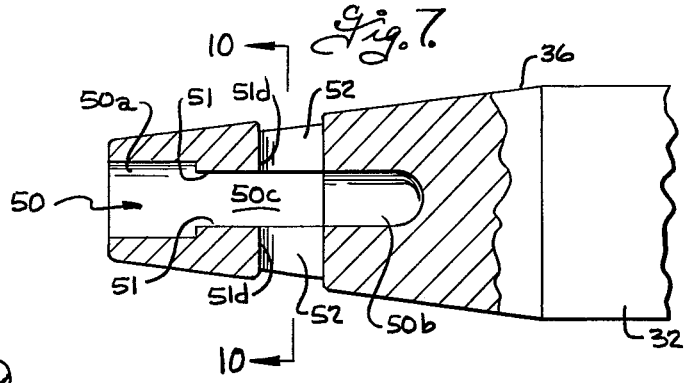
Fig. 9.
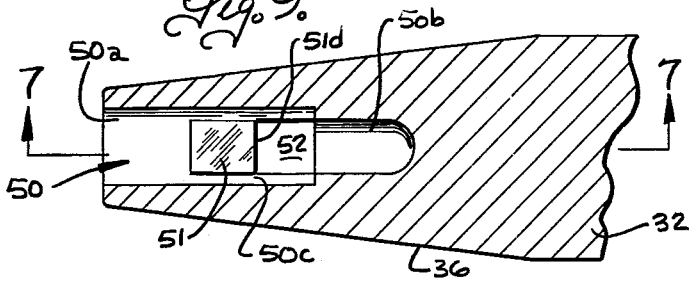
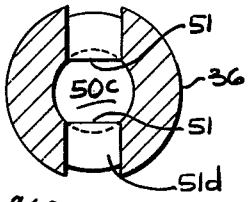
Fig. 10.
Fig. 11.
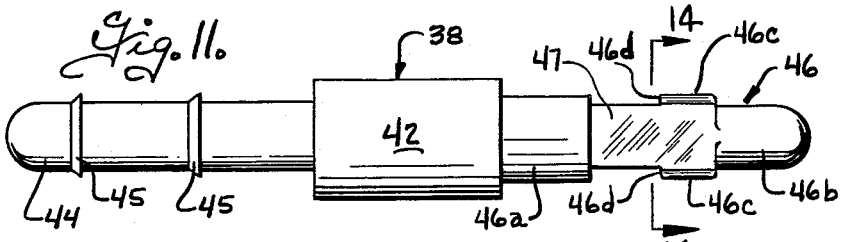
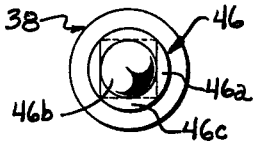
Fig. 12.
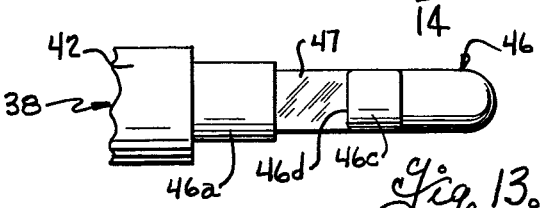
Fig. 13.
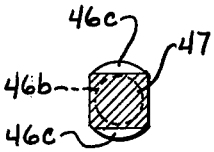
Fig. 14.
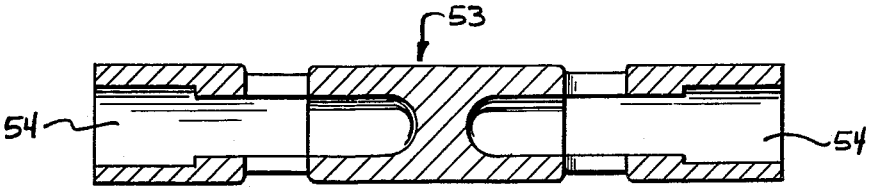
Fig. 15.
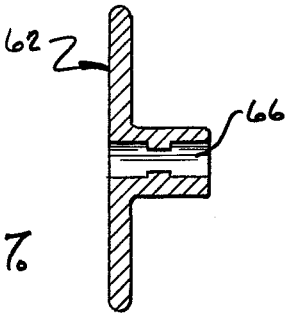
Fig. 17.
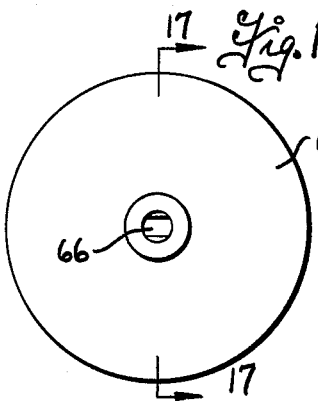
Fig. 16.

HAND KNITTING APPARATUS

CROSS REFERENCE

This application discloses and claims the subject matter of Disclosure Document No. 044033 filed Oct. 2, 1975.

BACKGROUND

This invention relates to knitting and more particularly to a hand knitting apparatus. This invention is an improvement in hand knitting apparatus of the type disclosed in U.S. Pat. No. 3,280,595 issued Oct. 25, 1966 to Lorraine A. Linstead.

In hand knitting carried on in the home, efficient work requires that the knitter use a large number of different knitting needles and related apparatus. This is due to the variations in the characteristics of articles she may knit. For example, the article can range from small and tubular, as a baby bootie, to large and flat, as a blanket. Thus, the shape of the article and the number of stitches may vary in any particular article being knitted and, obviously, different types and lengths of needles are required. Likewise, the size of the yarn selected or the particular design of the article may require any one of various needle sizes. For example, in decorative knitting, various sizes of needles may be required in the same row of stitches. This is true with respect to both straight and circular needles.

When the article being knitted is to be set aside temporarily, as frequently occurs with the hobbyist, or fitted on a person for size, it is desirable that a stitch holder or work holder be provided so that stitches are not dropped and the knitting ruined. Numerous stitch holders may be required for various size articles as described above. Thus the knitter may find herself faced with the purchase of a number of stitch holders, as well as different knitting needles, if she does a variety of knitting.

SUMMARY

The present invention pertains to a hand knitting apparatus of the type having a removable needle and more particularly to such an apparatus having means providing a disconnectable connection for the needle.

One feature of the invention is the provision of a new and simplified disconnectable connection for the needle. The present invention provides a hand knitting apparatus which includes a variety of carefully chosen related parts which are readily selectable and easily assembled into various knitting needle assemblies or stitch holders. The apparatus is adaptable to practically all of the situations that may be presented to the hand knitter, and particularly that she may provide either stitch holders, or circular or straight needle assemblies through the use of common elements and that she may provide such needle arrangements in different sizes, tips, and lengths. The flexible member or unit, as well as the rigid elongate member, may be utilized as a stitch holder by replacement of the needle by a flanged stitch stop.

According to the invention there is provided a hand knitting apparatus including a needle having a tip at one end and an opposite coupling end, an elongate unit having a coupling end removably connected to the needle, and cooperative means at the coupling ends providing a disconnectable bayonet-type connection between the needle and elongate unit.

These, and other features and advantages of the invention will be more readily understood by reference to the following description when taken in conjunction with the accompanying drawings.

DRAWINGS

FIG. 7. is a partial view of the coupling end of a needle and partially in cross-section taken along line 7—l7 of FIG. 9;

FIG. 8 is an end view of the needle as seen from the left of FIG. 7;

FIG. 9 is a partial cross-sectional view of the needle taken generally along line 9—9 of FIG. 8;

FIG. 10 is a cross-sectional view taken along line 10—10 of FIG. 7;

FIGS. 11–13 are, respectively, a front plan view, a right end view, and a top plan view of an adapter, the right hand end of which has a unique connector;

FIG. 14 is a cross-sectional view taken along line 14—14 of FIG. 11;

FIG. 15 is a longitudinal sectional view of a female coupling member adapted to be interposed between a pair of adjacent flexible units;

FIG. 16 is a plan view of a flanged stitch stop; and

FIG. 17 is a cross-sectional view taken along line 17—17 of FIG. 16.

DESCRIPTION

Figure 1:
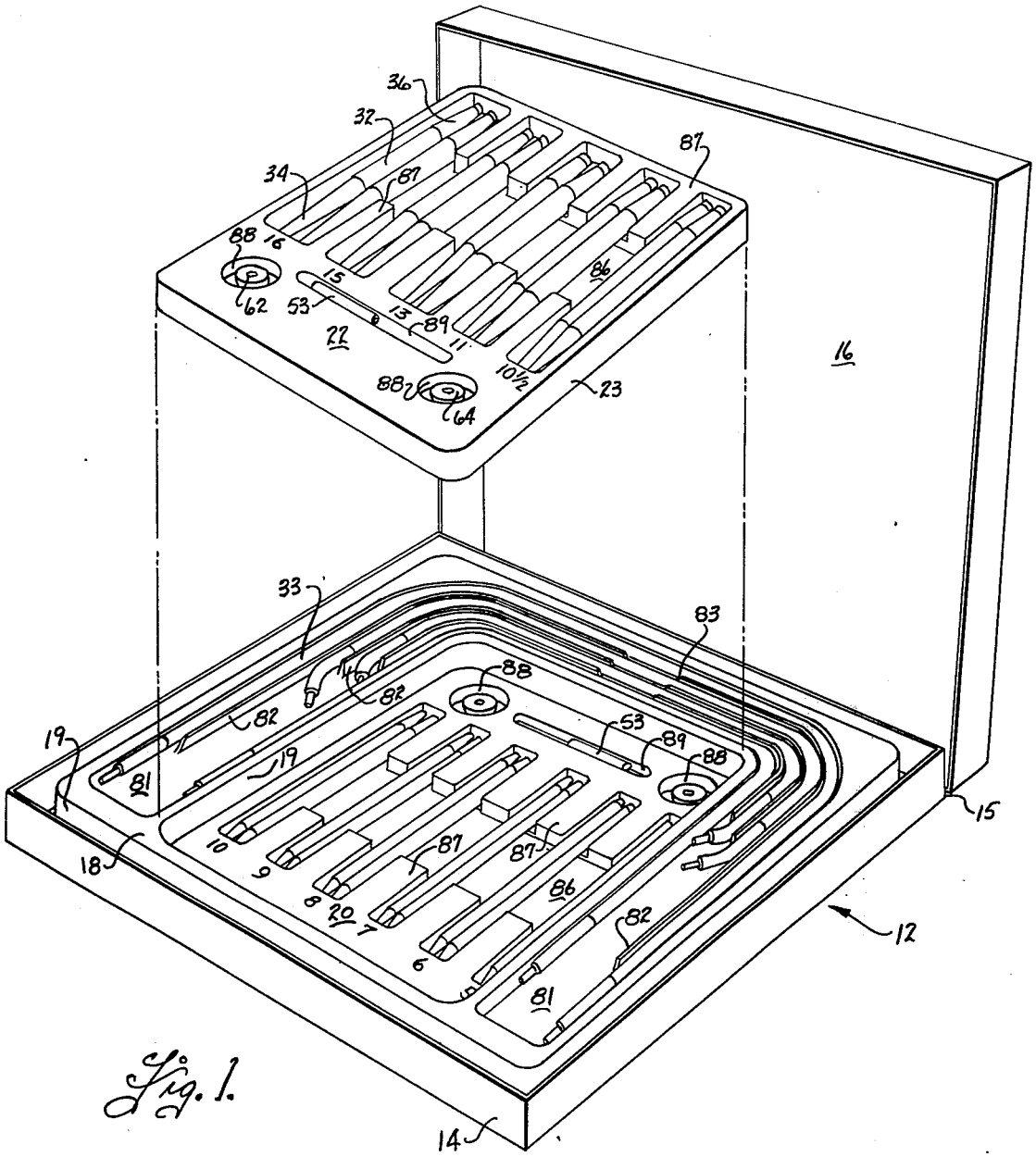
FIG. 1 is an exploded perspective view of a case containing items of the present invention.

Referring now more particularly to the drawings, a hand knitting kit is generally designated by the numeral 12. The particular kit, shown for purposes of illustrating the invention, comprises a container, a plurality of related members that may be assembled in different combinations and relationships, and means in the container for receiving and storing the individual members. In this instance, the container includes a generally rectangular box structure 14 having a base and sides and open at the top. A closure in the form of a lid 16 is hinged to the box, as at 15, in order that the lid is present for closing after the necessary parts required by the knitter are removed. The individual components which go together to make up the kit arrangement are assembled and positioned for easy access and storage. An attractive sectional holder member or shelf 18, suitably formed of plastic material and fitted within the box portion 14, is shown in FIG. 1. The shelf 18 has downturned marginal flanges 19 for supporting the same on the bottom or supporting section of the box 14. In order to permit the exposure of a number of available parts in the kit, the shelf 18 has a centrally disposed depression 20. A second shelf or tray 22 is adapted to reside in the depression and is supported by downturned marginal flanges 23.

Figure 2:
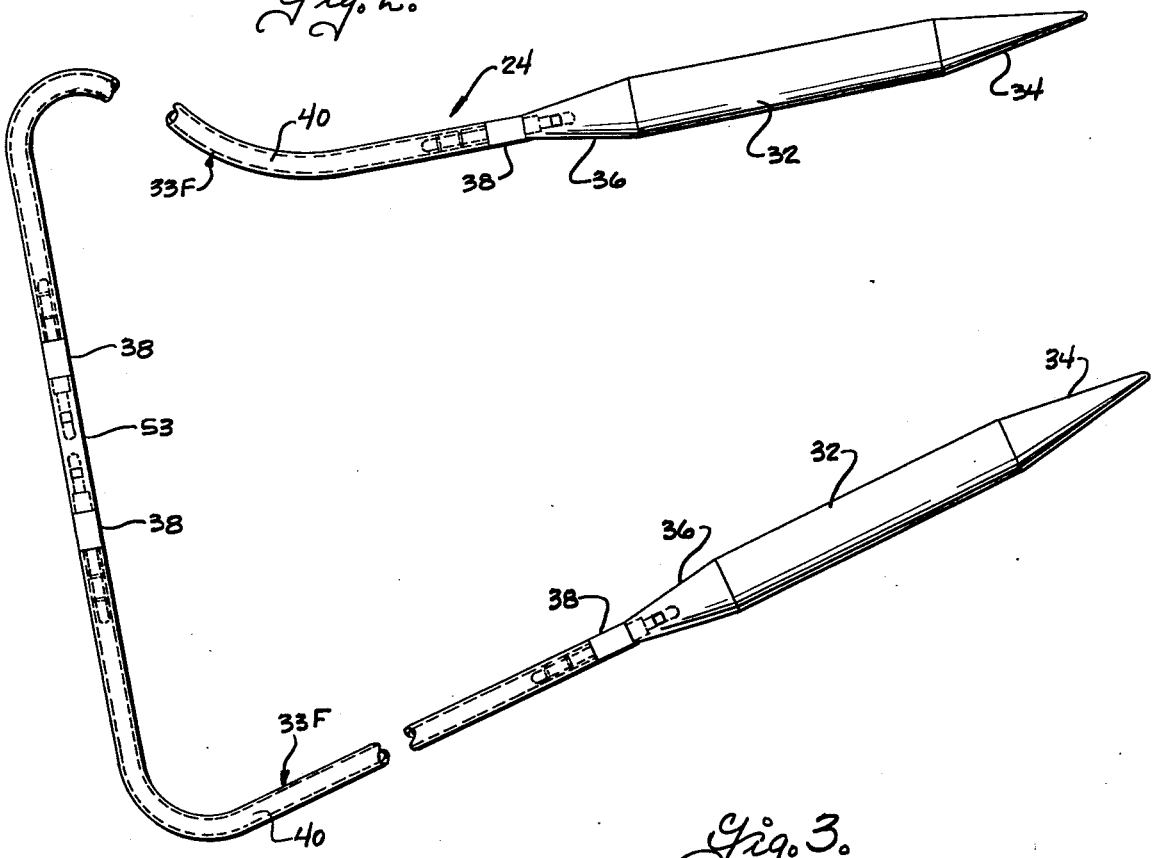
FIG. 2 is a perspective view showing a circular knitting needle assembly herein separable components are connected by devices constructed in accordance with the present invention.
Figure 4:
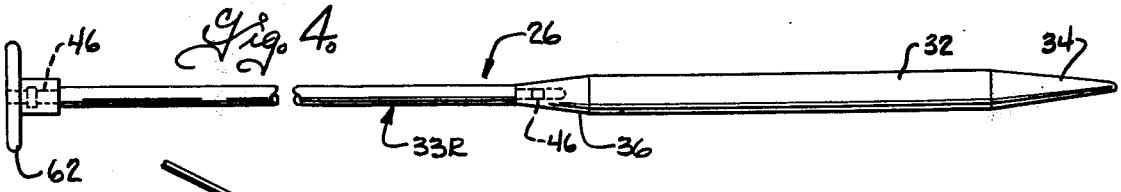
FIG. 4 is a plan view of a straight knitting needle assembly in which the unit connected to the needle is rigid.
Figure 6:
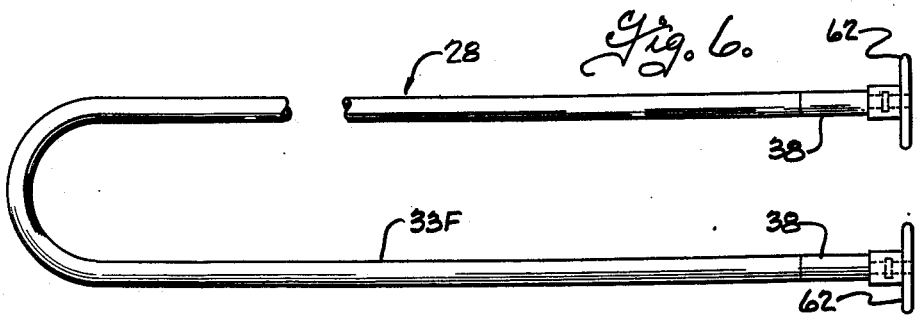
FIG. 6 is a plan view of a flexible member having flanged stitch stops at either end to form a stitch holder.

As indicated, the container has a variety of related parts which may be assembled in different combinations and relationships at the will of the user to provide a circular knitting needle assembly 24, as shown in FIG. 2, a straight knitting needle assembly 26, as shown in FIG. 4, or a stitch holder 28, as illustrated in FIG. 6. Each needle assembly 24 or 26 may be made up of needles 32 of any selected size and may embody one or more elongate units. The elongate units may be flexible, as shown at 33F in FIG. 2, or they may be rigid for the straight needles, as shown at 33R in FIG. 4. With this selectivity, the assemblies will have the length that is required for the number of stitches involved in the particular knitting project at hand.

The container illustrated in FIG. 1 conveniently holds needles 32 from size 5 through size 16. The needles are 4 to 4½ inches long with a tapered tip 34 at the forward end thereof. The lengths of the needles may vary as desired, and the number and sizes of needles may be more or less than described. The tips 34 may be of the usual or standard configuration illustrated, or may take any form (not shown) known to those skilled in the art. At the opposite ends the needles 32 are provided with an inwardly sloping or tapered portion 36 which provides a smooth transition to associated parts of smaller diameter to be hereinafter described. Typically the needle 32 is cylindrical, the tip 34 generally conical, and portion 36 frusto-conical. It is contemplated that portion 36 will terminate in an end having a diameter that is equal to the diameter of end couplings 38 of flexible units 33F, or rigid unit 33R. Preferably no needles will have a diameter smaller than the diameter of the end coupling 38 or rigid unit 33R; however, the smallest needle may be of substantially the same diameter and have a generally smooth body with no end taper 36, as illustrated in FIG. 5.

The flexible units 33F illustrated in FIGS. 2 and 6, comprise flexible tubular member or element 40 having the end couplings 38 associated with opposite ends. Each end coupling 38 includes an intermediate body portion 42 that has a diameter substantially equal to the outer diameter of the flexible tube 40, a projecting stem 44 of smaller diameter than the body 42 but not less than the inside diameter of the flexible element 40, and a male connector 46 hereinafter described in detail. In one form as shown in FIG. 11, stem 44 has a plurality of relatively sharp, annular retaining rings 45 thereon. In this manner the tubular element 40, when forced onto the stem 44, will engage and be retained by the rings 45. The length of the body 42 is not critical; however it does provide oppositely facing shoulders against which the flexible element 40 and the needle 32 can bear. Advantageously the tubular member 40 is formed of vinyl while the end couplings 38 are formed of nylon or polycarbonate, as are the needles 32 and rigid elements 33R. Other suitable materials having similar characteristics may be utilized.

Figure 3:
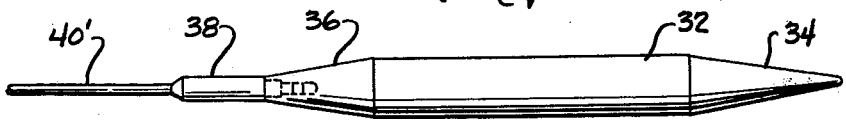
FIG. 3 is a partial plan view of a needle connected to a flexible unit which has a non-uniform diameter.
Figure 5:
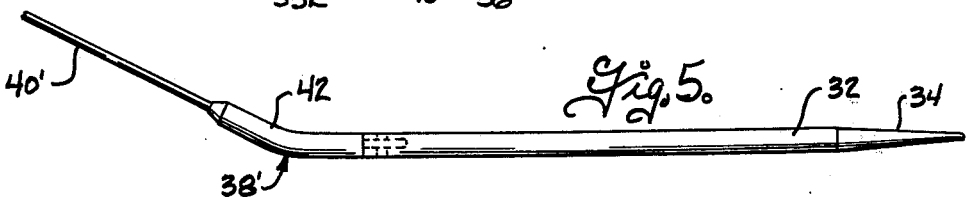
FIG. 5 is a partial view similar to FIG. 3 but showing a different form of end coupling member which forms an angular connection between the flexible unit and needle.

An alternate embodiment of the tubular member is illustrated in FIGS. 3 and 5. These views illustrate a stretched nylon cord 40′ of reduced diameter from the end coupling 38. The stretched nylon cord may be connected to the coupling in any convenient manner. If desired, a solid plastic cord may be molded integral with the coupling.

The end couplings 38 may take different forms, and one alternate form is shown in FIG. 5 where the intermediate body portion 42 is bent so that an obtuse angle is formed.

Attention is now directed to FIGS. 11–14. In a preferred embodiment, body portion 42 is 0.150 inch in diameter, and male connector 46 includes a first cylindrical portion **46*a* which is 0.100 inch in diameter and a second cylindrical portion 46*b* which is 0.072 inch in diameter. Intermediate the cylindrical portions is a rectangular portion 47 which is 0.072 × 0.075 inch. On portion 47 are oppositely facing bosses or prongs 46*c*. As best seen in FIG. 12, the prongs have semicircular outer faces which are coextensive with the outer surface of first cylindrical portion 46*a*. In other words, the surface of prong 46*c* which can be seen in FIG. 13 is 0.100 inch from the corresponding surface of the oppositely facing prong. Each prong 46*c* has a shoulder or stop face 46*d* which lies in a plane perpendicular to the axis of the cylinders, and facing the first cylindrical portion 46*a*. The stop faces 46*d*** are the bearing areas when the units are interconnected.

Turning now to FIGS. 7–10, it can be seen that the needle 32 has a female connector or socket 50 in its tapered portion 36. The socket includes a first cylindrical cavity **50*a* adjacent the end of the needle, and a second cylindrical cavity 50*b* spaced inwardly therefrom. These two cavities are shaped and sized to receive the corresponding first and second cylindrical portions 46*a* and 46*b*** of the male connector, and conveniently have diameters 0.001 inch larger than their counterparts.

The portion of the socket between **50*a* and 50*b* is very interestingly shaped (see FIG. 10). It may be considered, as best suggested by FIG. 7, as a part of cavity 50*b* with opposite sides, 180° apart, enlarged to the diameter of cavity 50*a*. In another respect, as suggested by FIG. 9, intermediate cavity 50*c* may be considered a continuation of the cylindrical cavity 50*a* with lands 51 extending inwardly, toward the axis of the needle, to the level of the diameter of cavity 50*b*. It is important to understand, however, that the surface of land 51 which is seen in plan view in FIG. 9, is a flat surface. This can be seen in FIG. 10 which also illustrates the oppositely facing character of these two surfaces, as well as showing that they are parallel. In this manner, the parallel surfaces of portion 47 adjacent the prongs 46*c* can pass to a position adjacent the lands 51 when the coupling member 38 and needle 32 are properly oriented. At the innermost side of the lands 51 are shoulders 51*d* which are created by a diametrical hole 52 which intersects the intermediate cavity 50*c*. When the coupling member 38 and needle 32 have been oriented so the male connector 46 is inserted into the socket 50 until intermediate portion 42 contacts the end of the needle, the coupling member 38 and needle 32 may be reoriented by twisting them 90°. When this is done, the prongs 46*c* enter into the opening 52, and the shoulders 46*d* bear against shoulders 51*d*.** This maneuver is herein referred to as making a bayonet-type connection.

In performing the above-described reorientation, an interesting interaction occurs. Comparing FIGS. 10 and 14, it will be noticed that the lands 51 are closer than are the diametrically opposite corners of portion 47 which must pass over these lands during the reorientation. An interference occurs, but the corners pass over the lands either through compressing of the corners or dilating the lands, or possibly a combination of both actions. For this purpose the male element and needle are preferably formed of a strong but springy material, nylon and polycarbonate being examples of suitable materials.

Thus the end coupling 38 has two bosses 46*c* on an essentially square portion 47. When the square portion is in position between the lands 51 and rotated 90°, two of the corners of the square compress because of the interference incountered. After the rotation takes place, the two bosses 46*c* will be located in the opening 52 and the needle secured to the coupling 38. Disengagement is accomplished by twisting the parts 90° and pulling the needle from the coupling; in short, reversing the procedure. The amount of interference during rotation is determined by the material and the clearance provided. The round cylindrical projection 46*b*, which extends forward of portion 47, provides additional strength of the small parts, but it is not essential for the functions described above. As described herein, the parts are advantageously made of plastic or other deformable material; however, one part could be made of rigid material, such as a metal, relying on the other part to satisfy the deformation necessary for the rotational function. It should be noted that the male and female portions could be reversed if desired.

Summarizing, the units or assemblies 33F or 33R, as shown in FIGs. 2–6, have identical male connectors 46 projecting from each end for association with other components of the knitting kit to provide an assembled knitting apparatus suitable for the work at hand. Thus, the needles 32 have female connectors or sockets 50 formed therein so that the connector 46 at one one of the unit may be inserted into the socket 50 of such needle 32. At the other end of the unit may be associated another needle, as shown in FIG. 2, or a flanged stitch stop 62 as shown in FIG. 4. As illustrated in detail in FIGS. 16 and 17, the flanged stitch stop 62 resembles a button like head that has an internal socket 66 formed therein which is essentially identical to the socket 50 previously described. The connector 46 at the other end of the unit may be inserted into the socket 66 of the stitch stop 62 and twisted 90° to thus complete a straight needle assembly. In an ordinary arrangement, the user would assemble two such straight needle assemblies to be used together. Flanged stitch stops may also be used at both ends of a unit to form a stitch holder as shown in FIG. 6.

While the flexible units 33F may be of any desired length, a plurality of standardized lengths may be employed, so that by association of a single unit 33F with a needle 32, a knitting needle assembly of appropriate length may be provided. Such standardized flexible units 33F may, however, be associated to provide other assemblies where greater length is desired. For this purpose, a female coupling 53 is provided, as shown in FIG. 15. The coupling 53 constitutes a relatively short cylindrical body having a diameter substantially equal to the diameter of body 42 of the end couplings 38. The coupling 53 has axially disposed sockets 54 in each end to receive male connectors 46 of the couplings 38 as shown in FIG. 2. The sockets 54 are essentially identical to the socket 50 previously described, and the manner of assembly and disassembly is identical to that previously described.

From the foregoing description, it will be apparent that the present invention provides hand knitting apparatus having components which may be assembled by means of a new and simplified disconnectable connection. Various assemblies are possible as described above.

For storage of either the flexible units 33F or the rigid units 33R, a recess 81 is provided and it conveniently extends around three sides of the depression 20. A plurality of walls or partitions 82 are provided in the recess 81 to define individual grooves. So as to allow easy removal from each groove, the walls 82 have a length less than a length of the recess 81 and terminate near the center, as at 83, in order to provide space for the finger to reach in and remove the units.

In a similar manner, each of the shelves 18 and 22 has a recess 86 for holding a plurality of pairs of knitting needles 32. Each recess 86 has a plurality of walls 87 defining a compartment for each pair of needles. Recesses are also provided for stitch stops 62 and female couplings 53. The recesses are conveniently oversized to permit ready removal. In the embodiment illustrated, generally circular grooves 88 are provided in each shelf for the stitch stops, and elongate grooves 89 are provided in each shelf for the female couplings 53.

While the best known mode of practicing the invention has been illustrated and described herein, it is to be understood that changes and variations may be made by those skilled in the art without departure from the spirit and scope of the appended claims and I do not wish to be limited except as required by the appended claims.

What is claimed is:

1. A hand knitting apparatus comprising: a needle having a generally cylindrical body with a tip at one end and a coupling end remote therefrom; a elongate unit having a body with an outer diameter not greater than the cylindrical body of the needle and a coupling end removably connected to the coupling end of the needle; cooperative means at said coupling ends providing a disconnectable bayonet-type connection between the needle and elongate unit: the cooperative means including a male member on one of said coupling ends, and a female member on the other of said coupling ends: the male member including an axially elongate portion, and a prong thereon and extending radially therefrom a preselected distance; and the female member including an axially elongated internal socket sized to receive the elongate portion of the male member, an elongate groove at one side of the socket for the passage of the prong, and a recess angularly spaced from said elongate groove and defining an inwardly-facing shoulder against which the prong bears when the coupling ends are rotated after the prong has passed through the elongate groove.

2. A hand knitting apparatus according to claim 1, wherein the elongate unit is substantially rigid and has a flanged stop at the end remote from the coupling end.

3. A hand knitting apparatus according to claim 2, wherein the elongate unit and flanged stop have cooperative means providing a disconnectable bayonet-type connection between them.

4. A hand knitting apparatus according to claim 1, wherein the elongate unit is flexible and has a second coupling end, and including means at the second coupling end removably connected to the elongate unit.

5. A hand knitting apparatus according to claim 1, wherein the internal socket has a land adjacent the elongate groove; and wherein the elongate member is resilient to enable it to pass over the land when rotated.

6. A hand knitting apparatus according to claim 5 wherein:

the male member is formed on synthetic resin having resilient characteristics similar to nylon to provide the resiliency, and has a second prong disposed 180° from the first-mentioned prong; and the female member has a second elongate groove oriented 180° from the first-mentioned groove for passage of the second prong therealong, and has a second recess for the second prong, the recesses being formed by a diametrical hole extending through the needle at a location angularly spaced 90° from the grooves.

7. A hand knitting apparatus according to claim 6, wherein the male member has an enlarged cylindrical portion adjacent the body and the diameter of said cylindrical portion corresponding to the distance between the outer ends of the prongs, and the female member has an enlarged cylindrical socket at the coupling end of the needle and sized to receive the enlarged cylindrical portion of the male member, the diameter of the enlarged cylindrical socket being equal to the distance from the bottom of one groove to the bottom of the other groove.

8. A hand knitting apparatus according to claim 7, wherein the male member is on the elongate unit and has a second cylindrical portion extending from the prongs to a distal end, and the female member is on the needle and its internal socket has a portion internally of the diametrical hole sized and shaped to receive the second cylindrical portion.

9. A hand knitting apparatus comprising: a needle having a generally cylindrical body with a tip at one end and a coupling end remote therefrom: an elongate unit having a body with an outer diameter not greater than the cylindrical body of the needle and a coupling end removably connected to the coupling end of the needle: cooperative means at said coupling ends providing a disconnectable bayonet-type connection between the needle and elongate unit: the cooperative means comprising:

an elongate axial member extending from one of said coupling ends and including: a first cylindrical portion adjacent the body and having a diameter reduced from the body diameter, a second portion of still further reduced size extending from the first portion and being generally square in cross section, and a prong on the second portion and extending radially therefrom to an outer end at the level of the first cylindrical portion; and an axially elongated internal socket in the other of said coupling ends and including: a first cylindrical socket portion at the end of the body and sized to receive the first cylindrical portion of the elongate axial member, a second socket portion inwardly from the first and having opposed flat sides spaced to receive the second portion of the elongate axial member, an elongate groove at one side of the second socket portion for passage of the prong, and a recess radially spaced from said elongate groove for receiving the prong when the coupling ends are rotated after the prong has passed through the elongate groove.

10. A hand knitting apparatus according to claim 9, wherein the elongate unit is flexible and has a second coupling end, and including means at the second coupling end removably connected to the elongate unit.

11. A hand knitting apparatus according to claim 10, wherein the means at the second coupling end is a flanged stop.

12. A hand knitting apparatus according to claim 10, wherein the means at the second coupling end is a second needle substantially identical to the first-mentioned needle, so that the needles comprise a matching pair.

13. A hand knitting apparatus according to claim 12, including a plurality of further pairs of knitting needles providing an assortment of different sizes, each needle having a tip at one end and an opposite coupling end, each coupling end being substantially identical so the needles are interchangeable on the flexible elongate unit.

14. A hand knitting apparatus according to claim 9, wherein the elongate axial member is formed of a synthetic resin having resilient characteristics similar to flexible nylon.

15. A hand knitting apparatus according to claim 14, wherein the needle is formed of synthetic resin having characteristics similar to the synthetic resin used for the elongate axial member.

16. A hand knitting apparatus comprising: a needle having a body with a tip at one end and a coupling end remote therefrom; an elongate unit having a body with an outer dimension not greater than that of the body of the needle and a coupling end removably connected to the coupling end of the needle; cooperative means at said coupling ends providing a disconnectable connection between the needle and elongate unit; the cooperative means including a male member on one of said coupling ends, and a female member on the other of said coupling ends; the male member including an elongate portion, and a prong thereon and extending laterally therefrom a preselected distance; the female member including an axially elongated internal socket sized to receive the elongate portion of the male member and shaped for the passage of the prong, and an inwardly-facing shoulder against which the prong bears when the coupling ends are rotated after the male member has been inserted into the female member; and the needle being disengageable from the elongate unit by rotating the coupling ends and reversing the procedure.

17. A hand knitting apparatus comprising: a needle having a body with a tip at one end and a coupling end remote therefrom; an elongate unit having a body with an outer dimension not greater than that of the body of the needle and a coupling end removably connected to the coupling end of the needle; cooperative means at said coupling ends providing a disconnectable connection between the needle and elongate unit; the cooperative means including a male member on one of said coupling ends, and a female member on the other of said coupling ends; the male member including an elongate portion, and a prong thereon and extending laterally therefrom a preselected distance; the female member including an axially elongated internal socket sized to receive the elongate portion of the male member and shaped for the passage of the prong, and an inwardly-facing shoulder against which the prong bears when said members are mated; the internal socket having an inwardly-extending land; and the elongate member having at least a portion thereof resilient to enable it to pass over the land so that the prong bears against the shoulder.

18. A hand knitting apparatus comprising: a needle having a tip at one end and a coupling end remote therefrom; an elongate unit having a coupling end removably connected to the coupling end of the needle; cooperative means at said coupling ends providing a disconnectable connection between the needle and elongate unit; the cooperative means including:

an elongate member on one of said coupling ends and having a prong extending laterally therefrom; and an elongate internal socket in the other of said coupling ends and including: a socket portion sized and shaped to closely receive said elongate member, a groove at the side of the socket portion sized and shaped for passage of the prong, and a recess spaced from said groove for receiving the prong when the prong has passed through the elongate groove.

* * * * *